US006307581B1

(12) United States Patent
Uchiyama et al.

(10) Patent No.: US 6,307,581 B1
(45) Date of Patent: Oct. 23, 2001

(54) INK FILM UNIT AND FACSIMILE APPARATUS

(75) Inventors: Masahiro Uchiyama, Samukawa-machi; Tsutomu Yadera, Ninomiya-machi, both of (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/192,220

(22) Filed: Nov. 16, 1998

(30) Foreign Application Priority Data

Nov. 18, 1997 (JP) ..... 9-333684
Oct. 21, 1998 (JP) ..... 10-300056

(51) Int. Cl.[7] ..... B41J 35/28; B41J 17/32
(52) U.S. Cl. ..... 347/214
(58) Field of Search ..... 347/214; 400/207, 400/208, 208.1

(56) References Cited

U.S. PATENT DOCUMENTS

| | | | |
|---|---|---|---|
| 4,673,304 | | 6/1987 | Liu et al. . |
| 5,100,250 | | 3/1992 | Suzuki et al. . |
| 5,352,049 | | 10/1994 | Shiraishi et al. . |
| 5,695,292 | * | 12/1997 | Coote ..... 400/208.1 |

FOREIGN PATENT DOCUMENTS

| | | |
|---|---|---|
| 2-17356 | 2/1990 | (JP) . |
| 3-281279 | 12/1991 | (JP) . |
| 6-278298 | 10/1994 | (JP) . |
| 8-282044 | 10/1996 | (JP) . |
| 95/19889 | 7/1995 | (WO) . |

OTHER PUBLICATIONS

Ribbon Cartridge, IBM Technical Disclosure Bulletin, vol. 20, No. 12, pp. 5523–24, May 1987.*
English Language Abstract of JP 8–282044.
English Language Abstract of JP 3–281279.
English Language Abstract of JP 6278298.

* cited by examiner

*Primary Examiner*—Huan Tran
(74) *Attorney, Agent, or Firm*—Greenblum & Bernstein, P.L.C.

(57) ABSTRACT

The ink film unit is configured by fixing the fixed shaft that penetrates the inside of the hollow, cylindrical feeding reel, right side plate and left side plate and attaching the winding reel to the right side plate and left side plate in a pivotable manner. The main unit is provided with the grooves that house and position the right side plate and left side plate, and the U-figured holders that hold the feeding reel and winding reel. This makes it possible to reduce the space for installation of the ink film unit, reducing the size of the facsimile apparatus.

22 Claims, 17 Drawing Sheets

PRIOR ART

INK FILM UNIT AND FACSIMILE APPARATUS

BACKGROUND OF THE INVENTION

1. Field of the Invention

The present invention mainly relates to personal type home facsimile apparatuses.

2. Description of the Related Art

Recently, with respect to the recording system for a facsimile apparatus, there is a growing demand for a plain paper recording system which transfers to plain paper instead of a thermosensible paper recording system which uses rolled thermosensible paper. As the recording section for this plain paper there are a laser system and thermal transfer system, etc.

The laser system is used for a large facsimile apparatus mainly for business use. However, since it is technically difficult to reduce the size of the laser system, facsimile apparatuses with a small plain paper recording system mainly uses the thermal transfer system.

A conventional facsimile apparatus with the thermal transfer system houses the ink film in an ink film cassette and the main unit contains a space to install the ink film cassette.

FIG. 1 is a perspective view showing an example of ink film cassette in the conventional thermal transfer system facsimile apparatus.

In FIG. 1, the ink film cassette has feeding reel case 91 on one end and winding reel case 92 on the other. These two cases are assembled by combining upper frame 93 and lower frame 94 molded with synthetic resin, etc.

Upper frame 93 and lower frame 94 are provided with openings 95 and 96 for only those parts necessary for recording transcription to minimize the exposure of ink film 97.

Housing the ink film in such an ink film cassette allows the user to carry it with ease and makes it possible to wind the ink film stably.

However, the conventional facsimile apparatus with the ink recording system requires a large space to house the ink film cassette itself, which has been an obstacle to downsizing.

SUMMARY OF THE INVENTION

An objective of the present invention is to implement the downsizing of facsimile apparatuses with an ink and plain paper recording system.

The present invention achieves the objective above by constructing an ink film unit with a feeding reel wrapped with an ink film, winding reel that winds up said ink film and a pair of tabular ink film holders that hold the both ends of said feeding reel and said winding reel in a pivotable manner and providing the facsimile apparatus with housing grooves to house and position said ink film holder and U-figured holders that hold the feeding reel and winding reel in a pivotable manner.

DETAILED DESCRIPTION OF THE PREFERRED EMBODIMENT

With reference now to the attached drawings, the embodiment of the present invention is explained in detail below.

(Embodiment 1)

Figure 1:
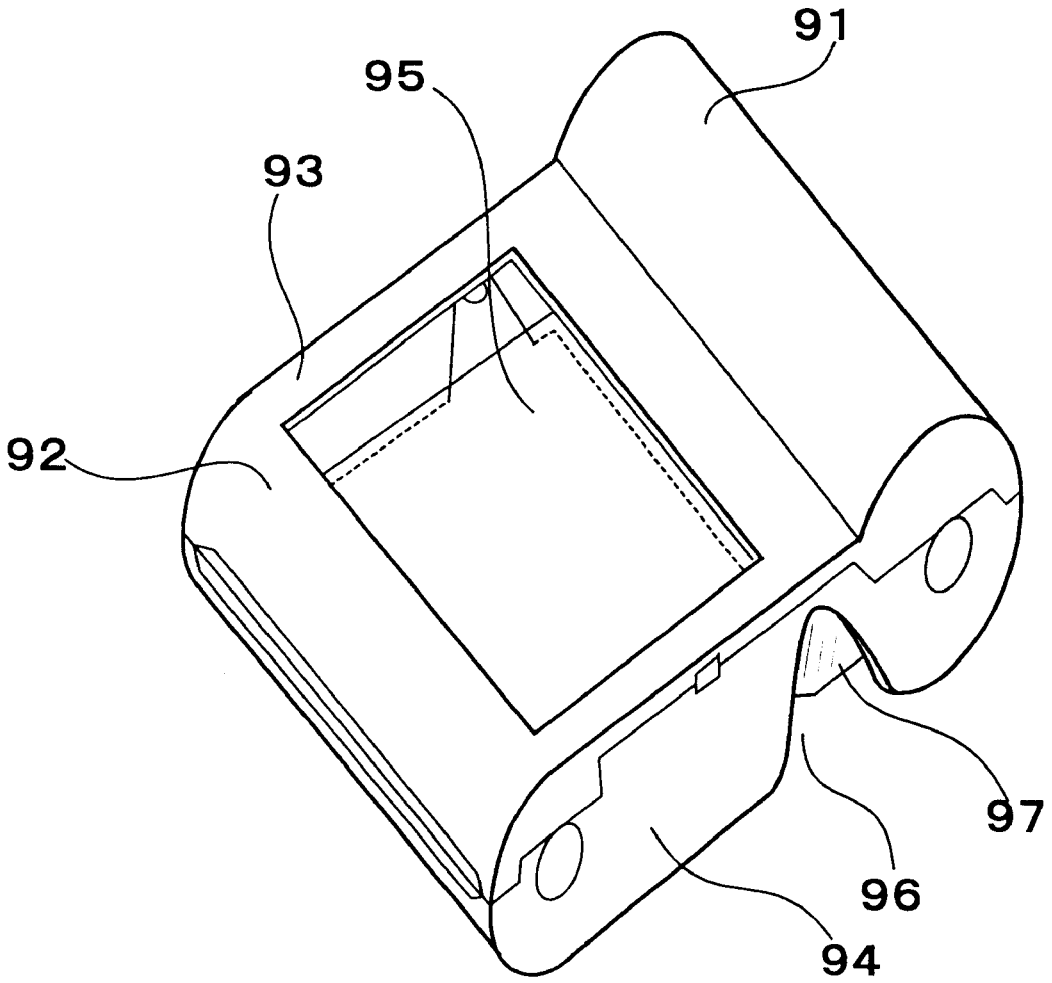
FIG. 1 illustrates a perspective view showing the shape of an ink film unit of a conventional facsimile apparatus.
Figure 2:
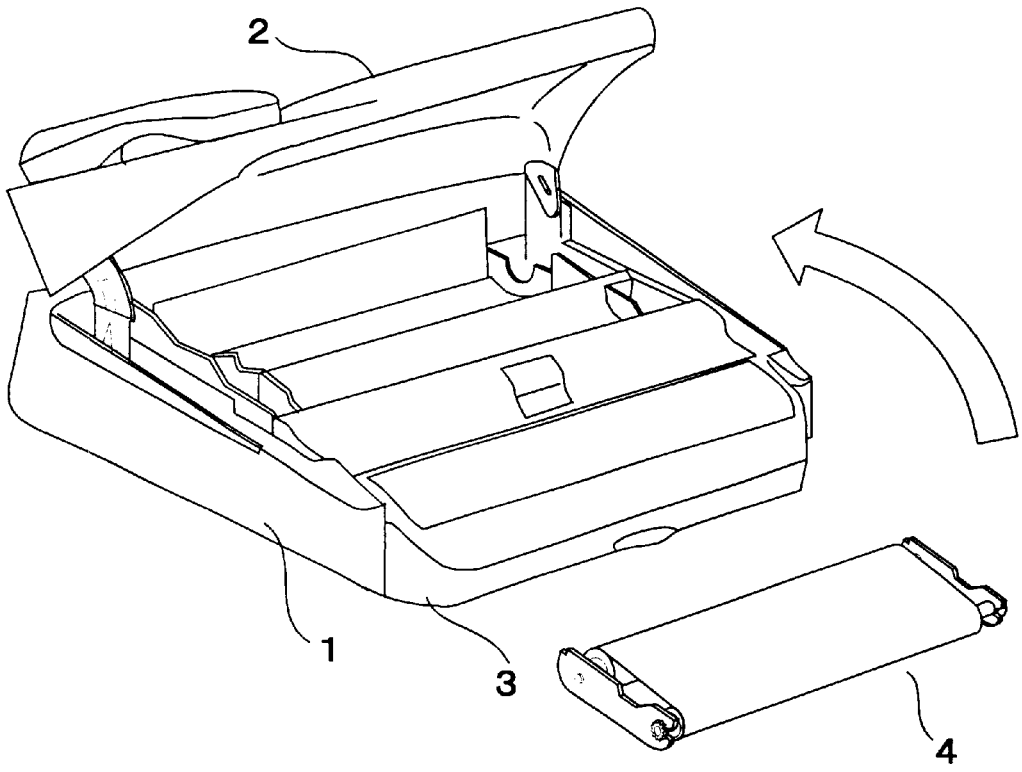
FIG. 2 illustrates a schematic perspective view of a facsimile apparatus according to an Embodiment 1 of the present invention.

FIG. 2 illustrates a schematic perspective view of a facsimile apparatus according to an embodiment 1 of the present invention.

As shown in FIG. 2, the facsimile apparatus of the present invention comprises main unit 1 that has a frame structure, operation panel 2 that has a frame structure and is fixed to the upper part of main unit 1 by means of a rotation shaft which is not shown in the figure in a pivotable manner and scanner 3 that is attached to the front of main unit 1 in a detachable manner and scans documents.

Furthermore, inside the rear part of main unit 1 is ink film unit 4 that contains an ink film to which ink was applied. In the following explanation, the side on which the user stands is assumed to be the front when operating the apparatus.

Figure 3:
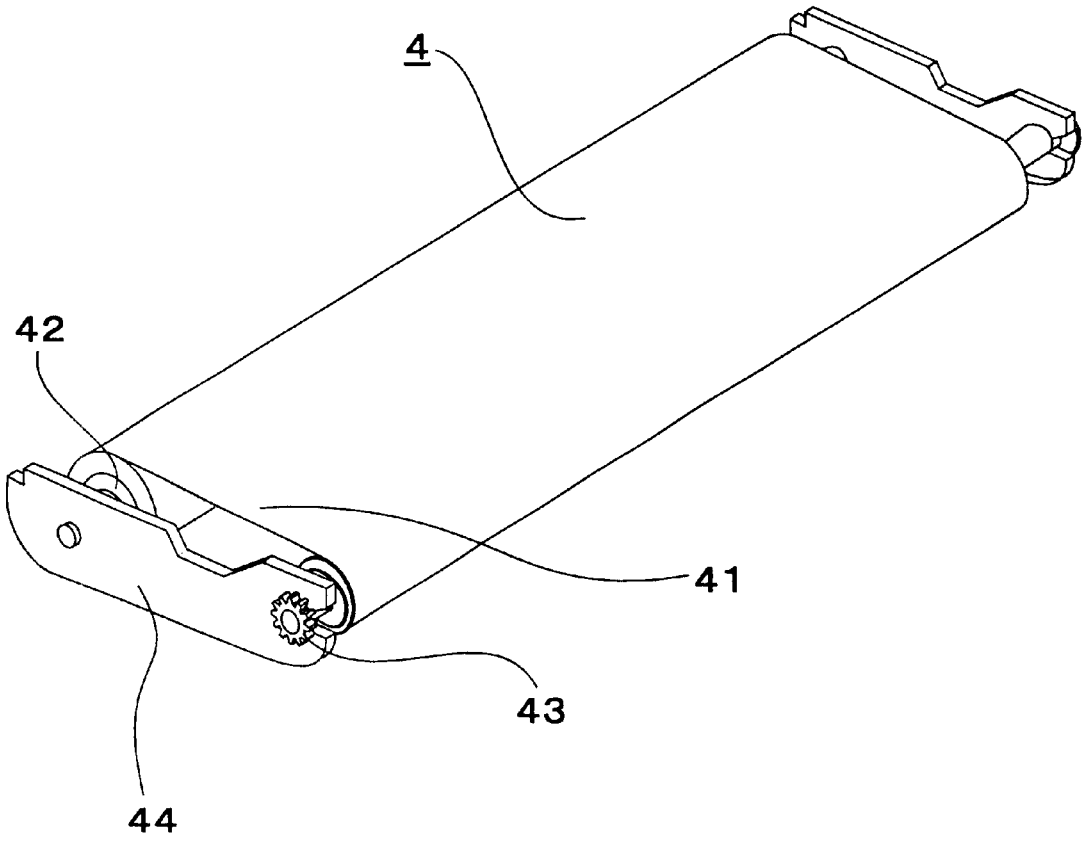
FIG. 3 illustrates a schematic perspective view showing the ink film unit of the facsimile apparatus according to the Embodiment 1.

FIG. 3 illustrates a schematic perspective view showing ink film unit 4 of the facsimile apparatus according to the embodiment 1. As shown in FIG. 3, ink film unit 4 consists of ink film 41 with hot melt ink applied to the base material, feeding reel 42 around which ink film 41 is wound before use, winding reel 43 that winds ink film 41 in accordance with recording transcription operation, and ink film holder 44 that holds feeding reel 42 and winding reel 43, and ink film unit 4 is attached to main unit 1 with winding reel 43 facing forward.

Figure 4:
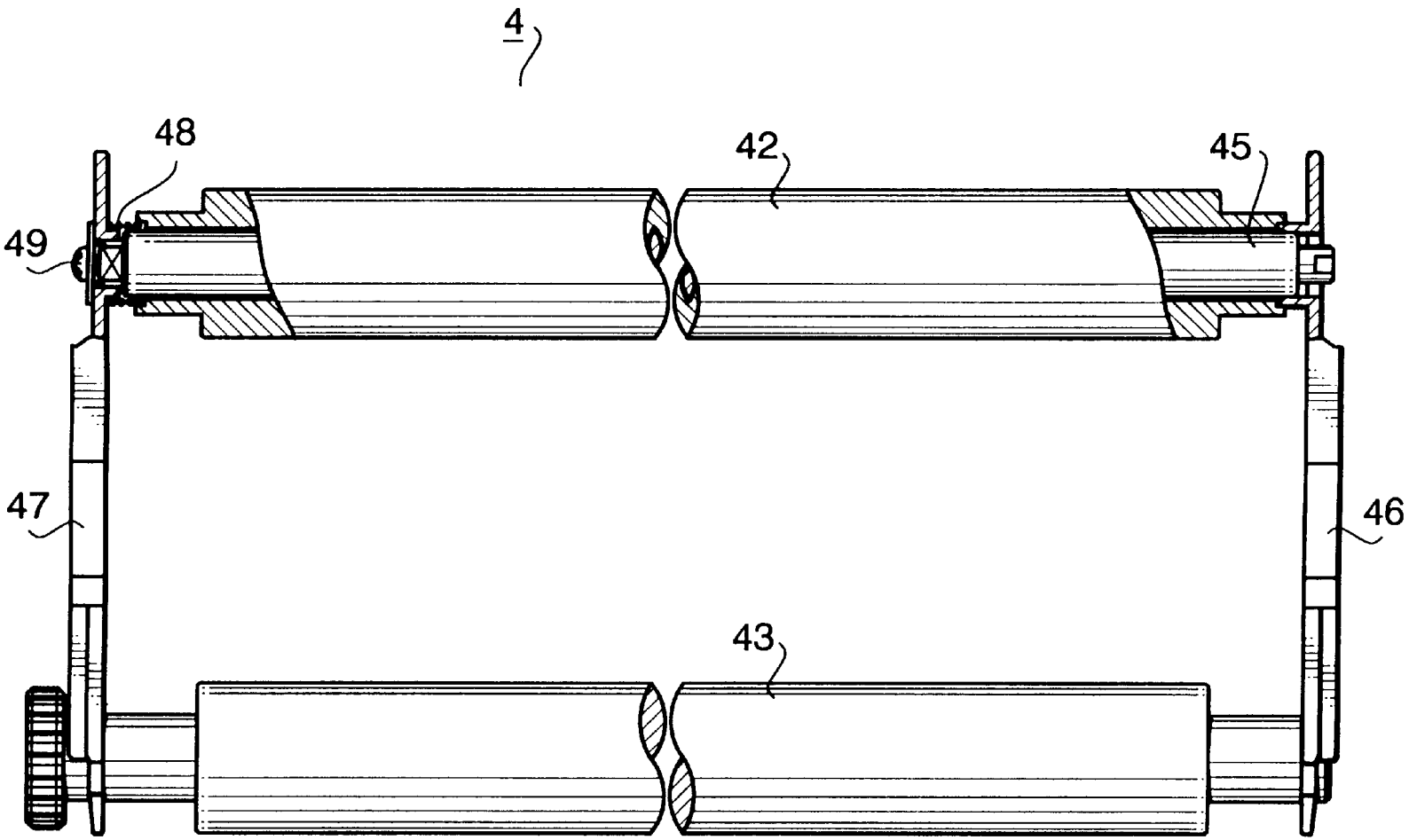
FIG. 4 illustrates a schematic top view of the ink film unit of the facsimile apparatus according to the Embodiment 1.

FIG. 4 illustrates a schematic top view of ink film unit 4 of the facsimile apparatus according to the embodiment 1. Ink film 41 is omitted here for brevity's sake.

Details of each component of ink film unit 4 are explained below according to the assembly procedure.

First, the explanation below illustrates the case where fixed shaft 45 is attached to right side plate 46.

Figure 5A:
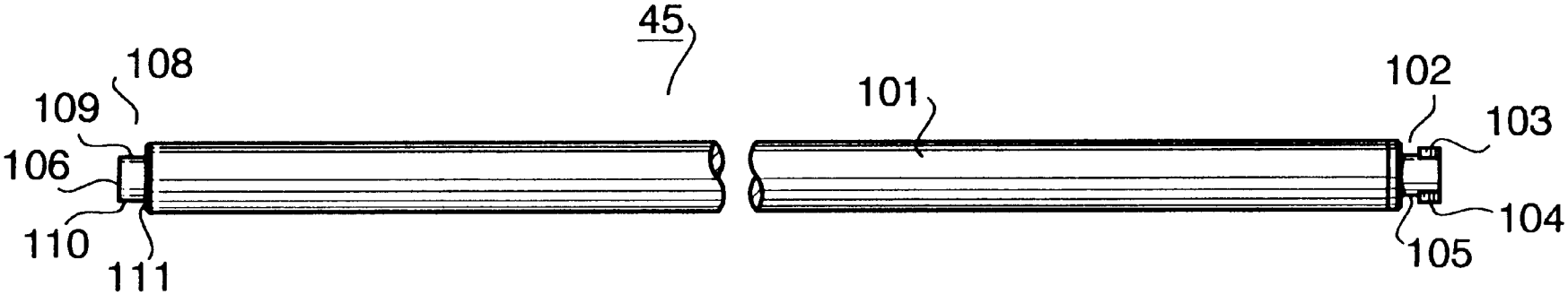
FIG. 5A, FIG. 5B and FIG. 5C illustrate plan view the fixed shaft of the facsimile apparatus according to the Embodiment 1.
Figure 5B:
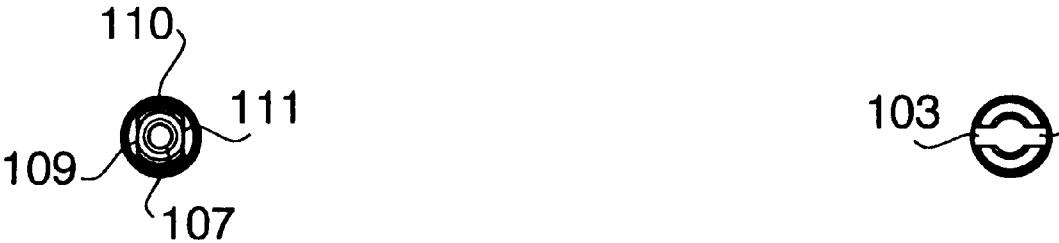
Figure 5C:
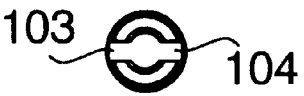
Figure 6A:
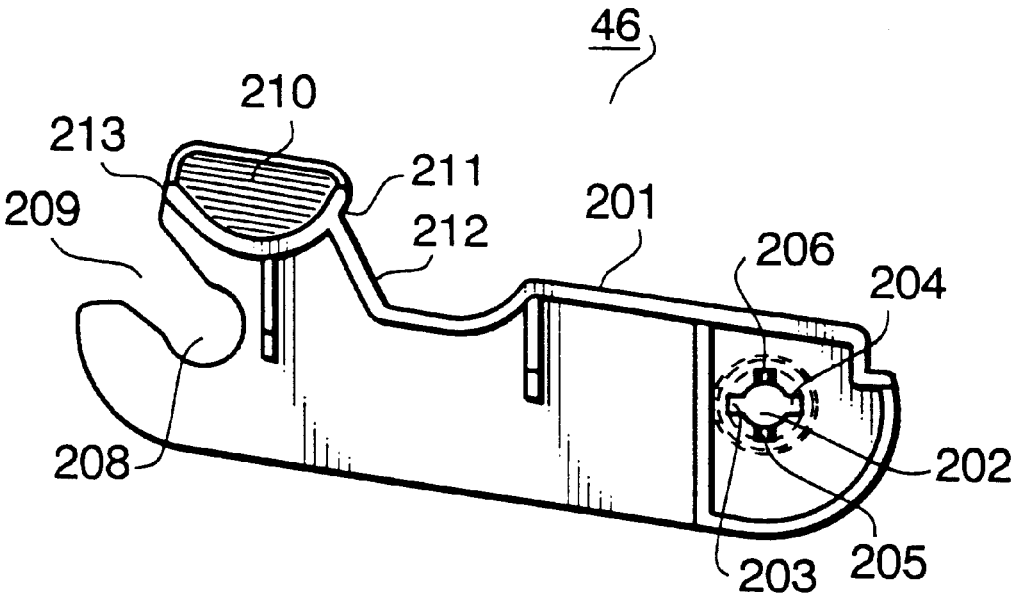
FIG. 6A and FIG. 6B illustrate floor plans showing the shape of the right side plate of the facsimile apparatus according to the Embodiment 1.

FIG. 5A is a front view of fixed shaft 45 and FIG. 5B is a left side view of fixed shaft 45 and FIG. 5C is a right side view of fixed shaft 45. FIG. 6A is a right side view of right side plate 46 and FIG. 6B is a top view of right side plate 46.

As shown in FIG. 5A and FIG. 5C, fixed shaft 45 has a total length longer than that of feeding reel 42. Central part 101 has a cylindrical form with a uniform diameter and right end 102 is provided with cylinder 105 shaved in a cylindrical form to a certain length leaving a pair of opposing protrusions 103 and 104.

Figure 6B:
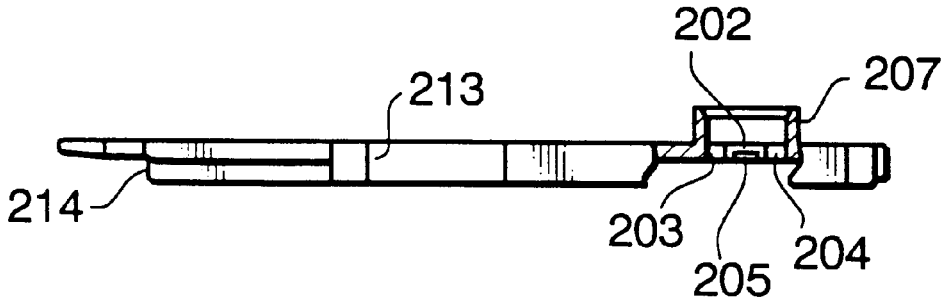

Furthermore, as shown in FIG. 6A and FIG. 6B, right side plate 46 is a rectangular thin plate with more frontage than depth and is provided with several beams 201 for reinforcement and at the center of its rear part is circular through hole 202 ("notched hole") which is larger in diameter than cylinder 105 of fixed shaft 45 and smaller in diameter than central part 101 of fixed shaft 45.

It is also provided with notches 203 and 204 which are greater than protrusions 103 and 104 of fixed shaft 45 on both sides of circular through hole 202 in horizontal direction and grooves 205 and 206 with a depth about half the plate thickness, a little larger than protrusions 103 and 104 of fixed shaft 45 in direction perpendicular to notches 203 and 204 from the center of circular through hole 202.

Fixed shaft 45 with such a configuration is fitted into right side plate 46 by passing from left to right protrusions 103 and 104 of fixed shaft 45 through circular through hole 202 and notches 203 and 204 of right side plate 46 placed with the rear side facing leftward, then rotating fixed shaft 45 by approximately 90° and pulling it leftward until protrusions 103 and 104 come to fit into grooves 203 and 204.

Figure 7:
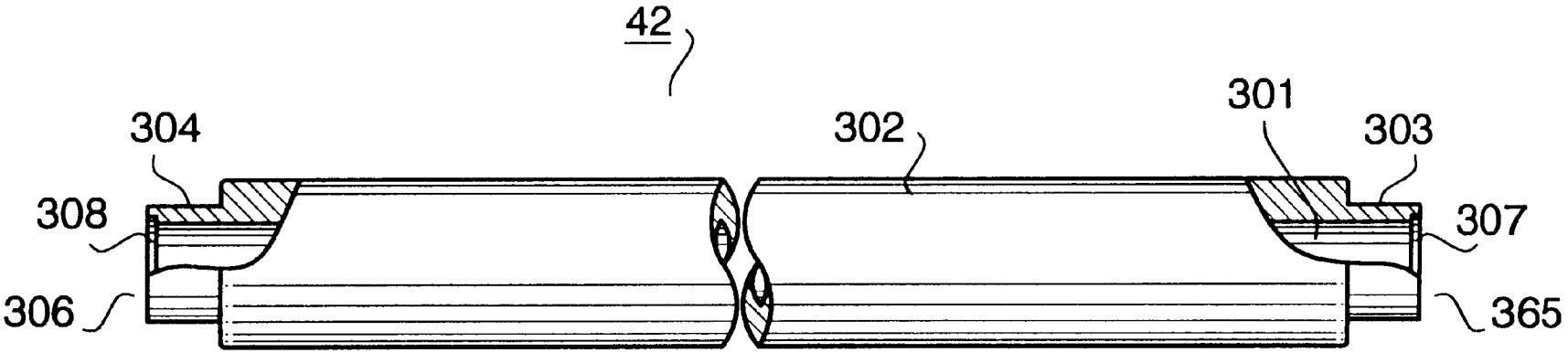
FIG. 7 illustrates a floor plan showing the shape of the feeding reel of the facsimile apparatus according to the Embodiment 1.

Then, the case where feeding reel 42 is attached to fixed shaft 45 and right side plate 46 is explained. FIG. 7 is a front view of feeding reel 42.

As shown in FIG. 7, feeding reel 42 has a multi-cylindrical form and contains penetrating hollow part 301 which has a uniform diameter a little larger than that of fixed shaft 45 at the axial center. Central part 302 has a cylindrical form with a uniform diameter a little larger than the width of ink film unit 41 and right end 303 and left end 304 are shaved to a cylindrical form thinner than central part 302 and right side 305 and left side 306 are provided with circular holes 307 and 308 with a prescribed depth.

As shown in FIG. 6A and FIG. 6B, disk-figured convex part 207 which is concentric with circular through hole 202 is provided at the center of the rear part on the back of right side plate 46. Disk-figured convex part 207 has a height greater than the depth of feeding reel circular hole 307 and an outer diameter smaller than the diameter of circular hole 307 of feeding reel 42 with an inner diameter greater than the widths of protrusions 103 and 104 of fixed shaft 45.

Feeding reel 42 with such a configuration is fitted in by passing fixed shaft 45 through hollow part 301 and moving it from left to right and engaging it with disk-figured convex part 207 of right side plate 46.

As shown above, since fixed shaft 45 serves as the shaft core of feeding reel 42 and part of ink film holder 44 at the same time, it can keep the form of the ink film unit fixed and rotation of feeding reel 42 stable as well.

Figure 8A:
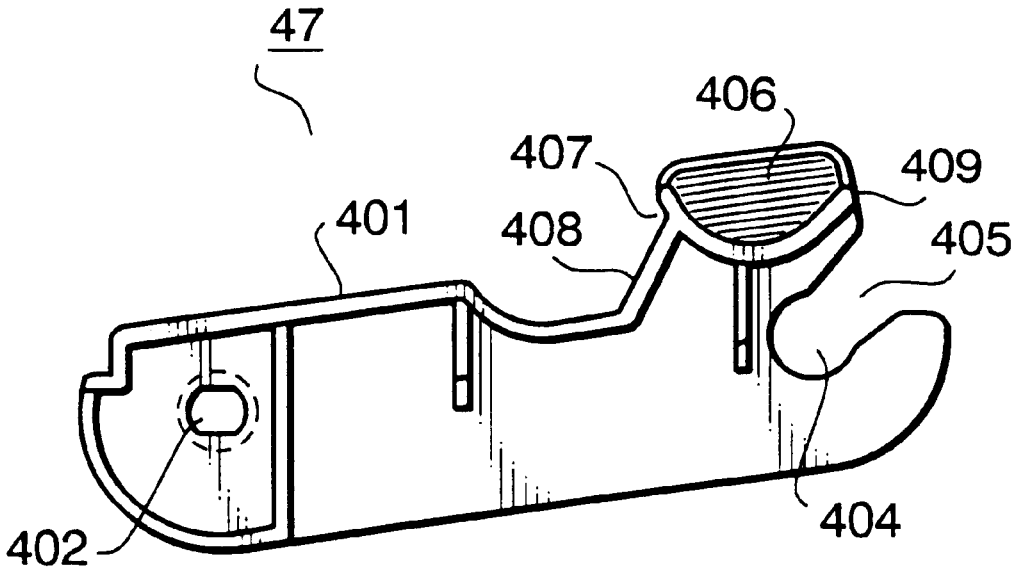
FIG. 8A and FIG. 8B illustrate floor plans showing the shape of the left side plate of the facsimile apparatus according to the Embodiment 1.

Then, the case where left side plate 47 is attached to feeding reel 42 and fixed shaft 45 is explained. FIG. 8A is a left side view of left side plate 47 and FIG. 8B is a top view of left side plate 47.

As shown in FIG. 5A and FIG. 5B at the center of left side 106 of fixed shaft 45 is tapped (screw) hole 107 that engages with screw 49. Left end 108 is shaved to a prescribed length in a cylindrical form and further shaved flat by a prescribed width toward the central axis, forming planes 109 and 110 and stepped plane 111.

Figure 8B:
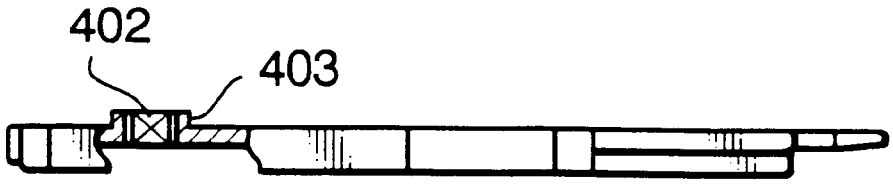

As shown in FIG. 8A and FIG. 8B, left side plate 47 is a rectangular thin plate with more frontage than depth and is provided with several beams 401 for reinforcement and at the center of its rear part is through hole 402 which has a shape similar to left end 108 of fixed shaft 45 in vertical direction and is slightly larger than it in diameter.

Furthermore, at the center of the rear part of left side plate 47 is disk-figured protrusion 403 which is concentric with through hole 402. Disk-figured protrusion 403 has a height greater than the depth of circular hole 308 of the feeding reel and has an outer diameter smaller than the inner diameter of circular hole 308 of feeding reel with spring 48 fitted in.

As shown above, using one screw to fix right side plate 46 and left side plate 47 with fixed shaft 45 makes it possible to reduce both the number of parts and the assembly process.

Figure 9:
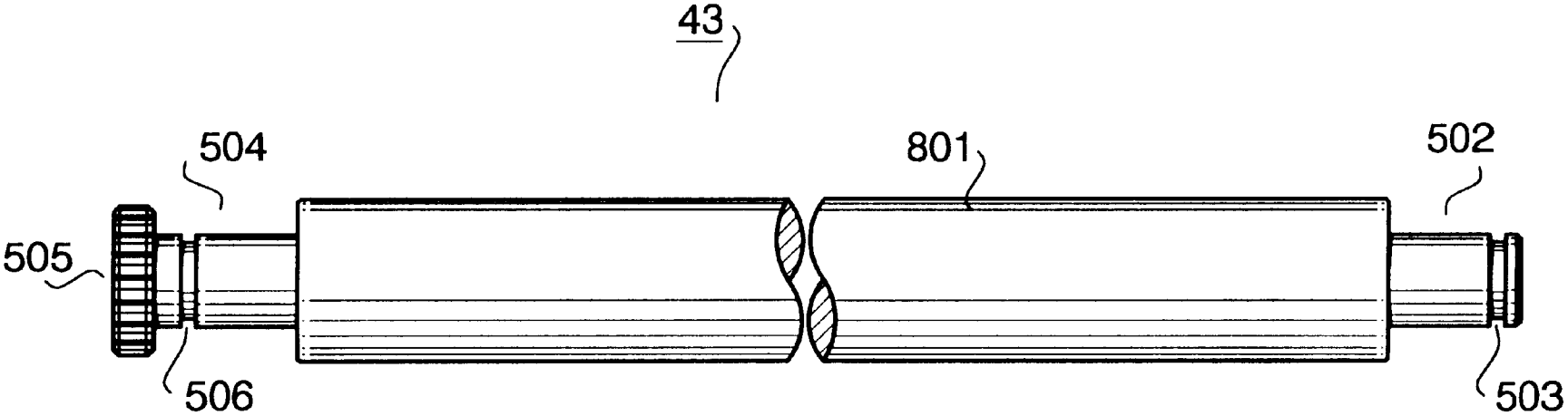
FIG. 9 illustrates a floor plan showing the shape of the winding reel of the facsimile apparatus according to the Embodiment 1.

Then, the case where winding reel 43 is attached to right side plate 46 and left side plate 47 is explained. FIG. 9 is a floor plan and front view of winding reel 43.

As shown in FIG. 9, winding reel 43 has a multi-cylindrical form and central part 501 is a cylinder with a uniform diameter a little longer larger than the width of ink film unit 41. Right end 502 of winding reel 43 is provided with groove 503 shaved to a prescribed width and depth and left end 504 of winding reel 43 is provided with cogwheel 505 formed concentrically and united with it and groove 506 shaved to a prescribed width and depth.

As shown in FIG. 6A and FIG. 6B, at the center of the front of right side plate 46 is circular through hole 208 with a diameter larger than that of groove 503 of winding reel 43 and smaller than that of right end 502. Circular through hole 208 is open diagonally up to the front and the width of this opening 209 is formed to be a little smaller than the diameter of groove 503 of winding reel 43.

As shown in FIG. 8A and FIG. 8B at the center of the front of left side plate 47 are also through hole 404 and opening 405 as with right side plate 46.

However, since, after winding reel 43 is fitted in, opening 209 of right side plate 46 and opening 404 of left side plate 47 revert to their original width, winding reel 43 does not come out of its position. Thus, it can hold winding reel 43 at the circular support without adding other parts. Furthermore, its ability to regulate axial movement of winding reel 43 provides stability when carrying ink film unit 4, facilitating its installation in main unit 1.

Once ink film unit 4 is assembled and installed in main unit 1 according to the attachment procedure explained above, the facsimile apparatus can perform recording transcription operation.

As shown in FIG. 6A and FIG. 6B, at the upper front of right side plate 46 is tab 210 for the user to pick up the plate to mount/dismount ink film unit 4 to/from main unit 1. On the front and rear surfaces of tab 210 are a plurality of convexities to prevent slippage in horizontal direction.

Likewise as shown in FIG. 8A and FIG. 8B, at the upper front of left side plate 47 is tab 406 symmetrical to tab 210 of right side plate 46 and on the front and rear surfaces of tab 406 are a plurality of convexities to prevent slippage in horizontal direction.

These allow the user to easily hold ink film unit 4 by picking up tabs 210 and 406.

Furthermore, on the rear part of tab 210 of right side plate 46 in mounting direction is binding frame 211 and on the rear part of tab 406 of left side plate 47 in mounting direction is binding frame 407.

These binding frames allow the user to also pick up planes 212 and 213 of right side plate 46 in mounting direction and planes 408 and 409 of left side plate 47 in mounting direction, and when dismounting ink film unit 4 set in main unit 1, this allows the user to smoothly take it out without being blocked by any other parts around ink film unit 4.

Then, the way to install ink film unit 4 of the facsimile apparatus in the embodiment 1 is explained with reference to the attached drawings.

Figure 10:
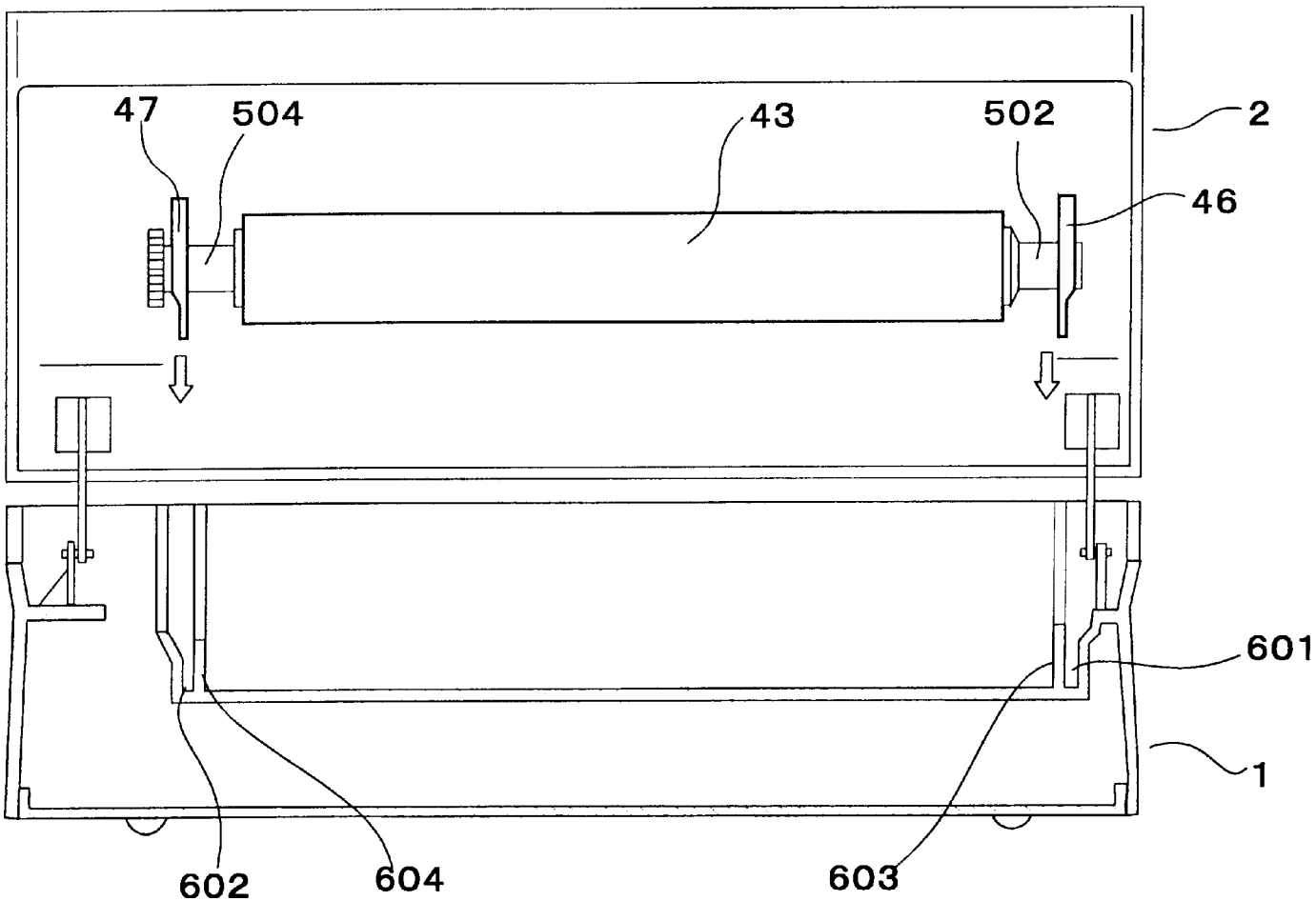
FIG. 10 illustrates a sectional view showing the state before installing the ink film unit of the facsimile apparatus according to the Embodiment 1.
Figure 11:
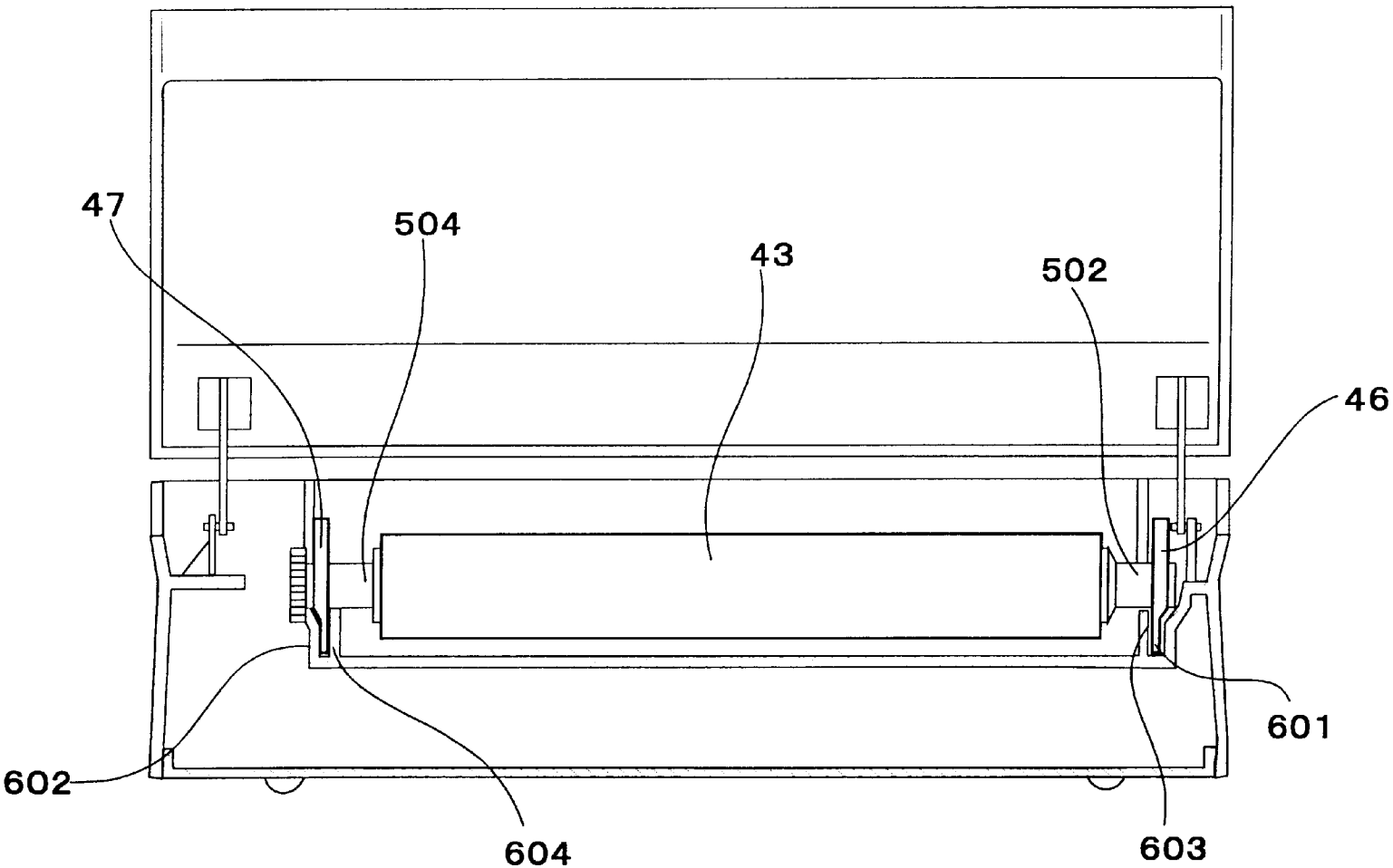
FIG. 11 illustrates a sectional view showing the state after installing the ink film unit of the facsimile apparatus according to the Embodiment 1.
Figure 12:
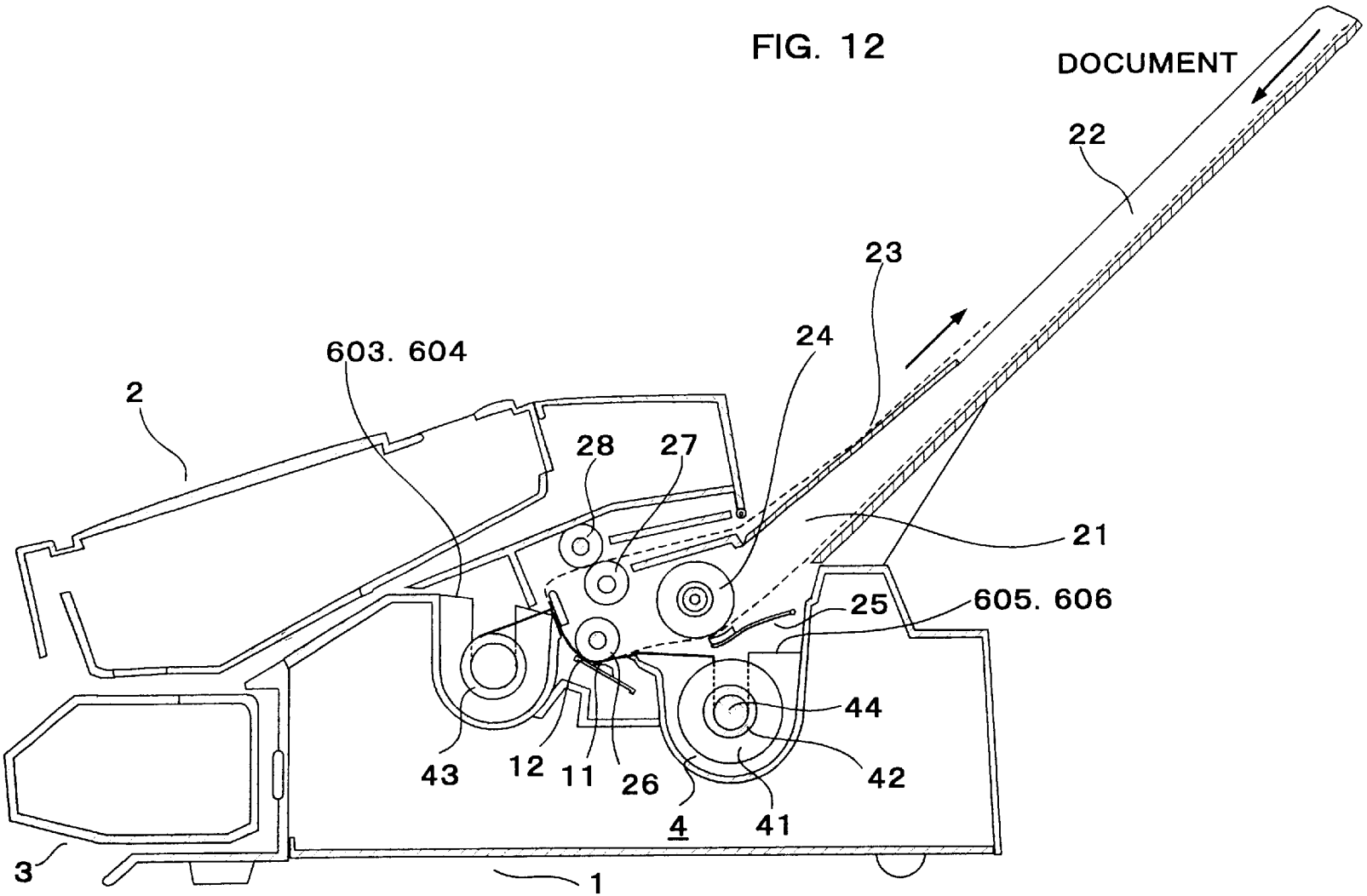
FIG. 12 illustrates a schematic sectional view showing the recording transcription block of the facsimile apparatus according to the Embodiment 1.

FIG. 10 illustrates a schematic front sectional view before installing the ink film unit in main unit 1 of the embodiment 1. FIG. 11 illustrates a schematic front sectional view after installing the ink film unit in main unit 1 of the embodiment 1. FIG. 12 illustrates a schematic side sectional view showing the configuration of the facsimile apparatus after the ink film unit is installed in main unit 1 in the embodiment 1.

As shown in FIG. 10 and FIG. 11, the frame of main unit 1 houses right side plate 46 and left side plate 47 and has grooves 601 and 602 which are used for rightward/leftward positioning.

As shown in FIG. 12, the frame of main unit 1 also has U-figured winding reel holders 603 and 604 that position winding reel 43 and U-figured feeding reel holders 605 and 606 that position feeding reel 42.

To install the ink film unit, the user holds tab 410 of right side plate 46 and tab 411 of left side plate 47 of ink film unit 4 by hand first and brings it to above main unit 1.

Then, the user fits the right and left sides of the ink film unit to grooves 601 and 602 and the front and back sides to winding reel holders 603 and 604.

In this state, the user lowers ink film unit 4 toward main unit 1 and takes the hands off the ink film unit. This completes the setup.

This allows the fixed frame of the main unit to regulate the movement other than non-axial rotation of the feeding reel and winding reel, enabling stable winding operation of the ink film. "As clearly shown in FIGS. 9–11, winding reel holders 603–606 (together "a holder") are U-shaped in both lateral sides of the structure forming the grooves 601–602 and regulate a position of the tabular ink holders 46 and 47 relative to the facsimile machine along both a direction perpendicular to an axis of the feeding reel 42 and a direction perpendicular to the winding reel 43."

Then the configuration of the recording block of the facsimile apparatus in the embodiment 1 is explained with reference to FIG. 12.

Between feeding reel 42 of ink film unit 4 of main unit 1 and winding reel 43 is recording head 11. During recording transcription operation, recording head 11 heats up and melts ink of ink film 41 and transfers ink to recording paper fed at recording position 12.

At the lower section of the rear part of operation panel 2 is recording paper insertion slot 21 which allows paper feeding tray 22 to be inserted to set recording paper. Furthermore, in the middle of the rear part of operation panel 2 is recording paper outlet 23 to discharge transferred recording paper.

On the rear part of operation panel 2 are ASF roller 24 that feeds recording paper to recording position 12, recording paper separation pad 25 that separates one sheet from a plurality of set recording paper sheets, recording roller 26 that gives tension to recording paper and ink film 41, recording paper discharge roller 27 that discharges recording paper after transcription and recording paper pinch roller 28 that assists in discharging recording paper.

Then the recording transcription operation of the facsimile apparatus configured as shown above is explained below.

First, a data reception signal from the receiving block which is omitted in the figure or pressing of the operation button by the user transmits a drive to ASF roller 24 which rotates clockwise in FIG. 12.

Then, one sheet of recording paper set in recording paper tray 22 is separated from other sheets by recording paper pad 25 and carried beneath ASF roller 24 and reaches recording position 12 between recording roller 26 and ink film 41.

The separated recording paper sheet is carried tensioned by recording roller 26. At the same time, in synchronization with the carrying of recording paper, winding reel 43 of ink film unit 4 rotates and image data in a memory on a printed circuit board which is not shown in the figure are transferred to recording paper sheet by recording head 11.

The recording paper sheet with image data transferred is carried upward by recording roller 26 and further carried backward by a frame guide of operation panel 2, passing between recording paper discharge roller 27 and document pinch roller 28 and discharged from recording paper outlet 23, which completes the recording transcription operation.

As explained above, the present invention can reduce the size of a facsimile apparatus with a plain paper recording system using ink by reducing the installation space of the ink film unit.

In addition, the present invention also maintains the ease of carrying the ink film unit and the stability in winding operation of the ink film unit.

(Embodiment 2)

Figure 13:
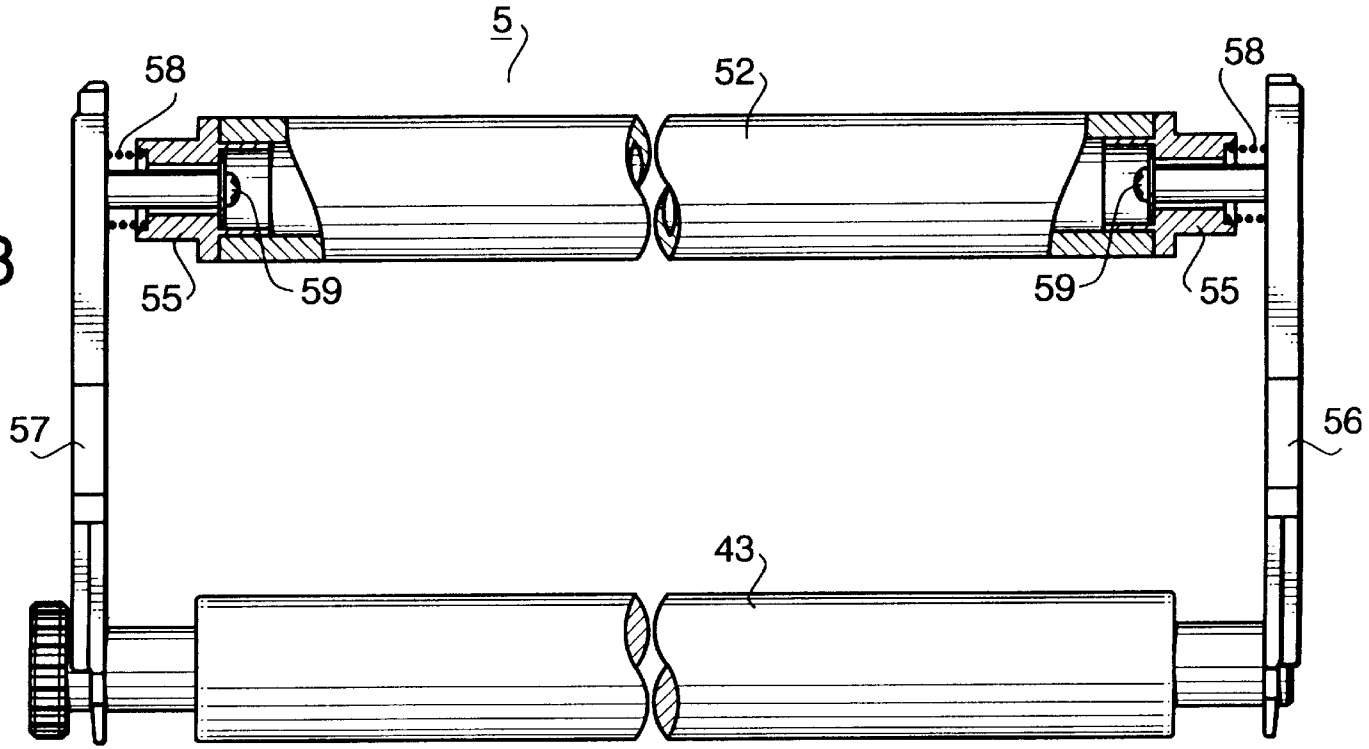
FIG. 13 illustrates an outlined top view showing the ink film unit of the facsimile apparatus according to Embodiment 2.

FIG. 13 illustrates an outlined top view of ink film unit 5 of the facsimile apparatus according to Embodiment 2. For a simplified explanation, ink film 41 is omitted in the figure.

As shown in FIG. 13, ink film unit 5 consists of supply reel 52 around which ink film 41 is wound before use, winding reel 43 that winds up ink film 41 according to the recording transfer operation, ink film holder 54 that holds supply reel 52 and winding reel 43, two supply reel supports 55 that support supply reel 52, and is attached to main unit 1 with winding reel 43 facing forward. Since ink film 41 and winding reel 43 have the same shapes as those of Embodiment 1, they are assigned the same numbers and their explanations are omitted.

Ink film holder 54 of ink film unit 5 comprises right side plate 56 and left side plate 57 that control the lateral movement of supply reel 52 and winding reel 43, coil spring 58 that controls the lateral movement of supply reel 52 by means of a spring and two screws 59 that fix supply reel supports 55 to right side plate 56 and left side plate 57.

The following is an explanation of how each component of ink film unit 5 in Embodiment 2 is attached according to the assembly procedure with reference to the attached drawings.

First, the step of attaching supply reel support 55 and coil spring 58 to right side plate 56 is explained.

Figure 14B:
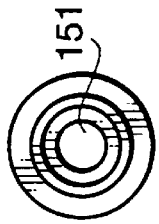
FIG. 14A and FIG. 14B illustrate floor plans showing the supply reel support of the facsimile apparatus according to Embodiment 2.
Figure 14A:
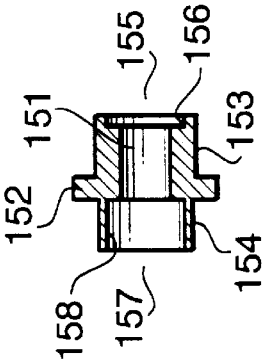

FIG. 14A and FIG. 14B illustrate floor plans showing supply reel support 55 of ink film unit 5 according to Embodiment 2. FIG. 14A is a front sectional view and FIG. 14B is a right side view. As shown in FIG. 14A and FIG. 14B, supply reel support 55 has a concentric multi-cylindrical form with through hollow section 151 of a uniform diameter smaller than the inside diameter of coil spring 58 at the axial center. Central section 152 has a cylindrical form of a uniform diameter and right end 153 and left end 154 are shaved to a cylindrical form thinner than central section 152. On right side 155 is circular hole 156 of a diameter a little larger than the outer diameter of coil spring 58 and a prescribed depth, and on left side 157 is circular hole 158 of a prescribed depth.

Figure 15A:
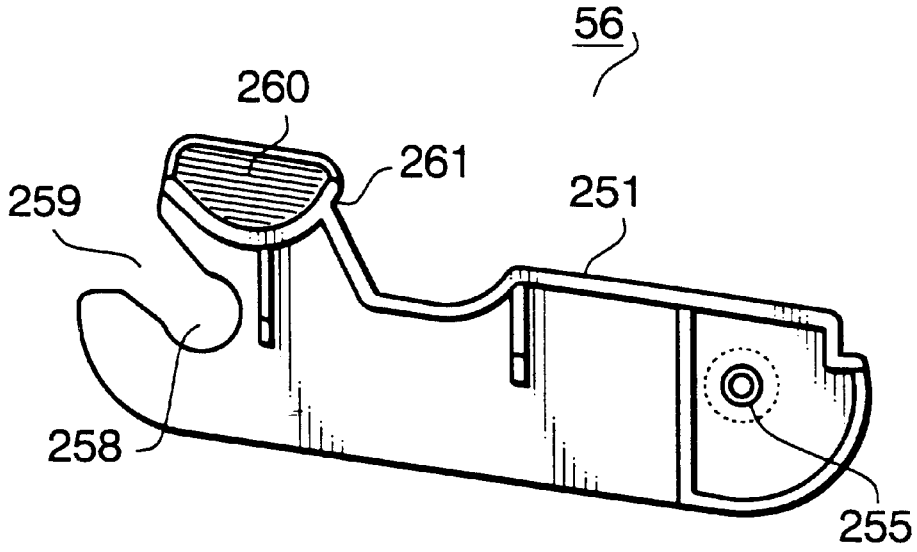
FIG. 15A and FIG. 15B illustrate floor plans showing the shape of the right side plate of the facsimile apparatus according to Embodiment 2.
Figure 15B:
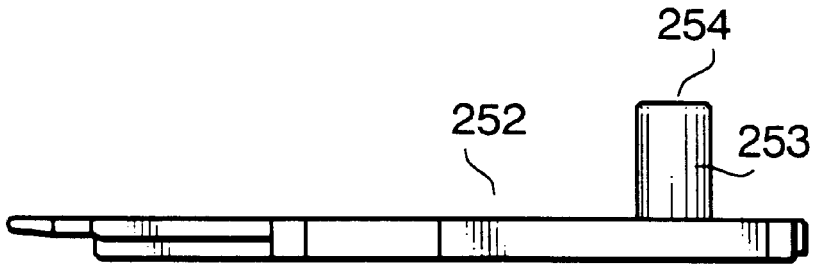

FIG. 15A and FIG. 15B illustrate floor plans of right side plate 56 of ink film unit 5 in Embodiment 2. FIG. 15A is its front view and FIG. 15B is its top view. As shown in FIG. 15A and FIG. 15B, right side plate 56 is a thin plate with more frontage than depth and is provided with several beams 251 for reinforcement. At the rear center of its back side 252 is cylindrical section 253 of a diameter smaller than that of hollow section 151 of supply reel support 55 and at the center of end face 254 of cylindrical section 253 is screw hole 255 that engages with screw 59.

As in the case with right side plate 46 of Embodiment 1, at the front center of right side plate 56 is circular through hole 258 of a diameter larger than that of groove 503 of winding reel 43 and smaller than that of right end 502. Circular through hole 258 is open diagonally up to the front and the width of this opening 259 is formed to be a little smaller than the diameter of groove 503 of winding reel 43.

Furthermore, at the upper front of right side plate 56 is tab 260. On the front and rear surfaces of tab 260 are a plurality of convexities to prevent slippage in horizontal direction. Furthermore, on the rear part of tab 260 of right side plate 56 in mounting direction is binding frame 261.

By covering cylindrical section 253 of right side plate 56 placed with its rear side 252 facing leftward with coil spring 58, then covering it with supply reel support 55 from right side 155 and fitting screw 59 into screw hole 255 and tightening it, supply reel support 55 and coil spring 58 are attached to right side plate 56.

In Embodiment 2, left side plate 57 and right side plate 56 are symmetrical to each other and supply reel support 55 and coil spring 58 are attached to left side plate 57 following the same step.

Then, the step of attaching supply reel 52 to supply reel support 55 is explained below.

Figure 16:
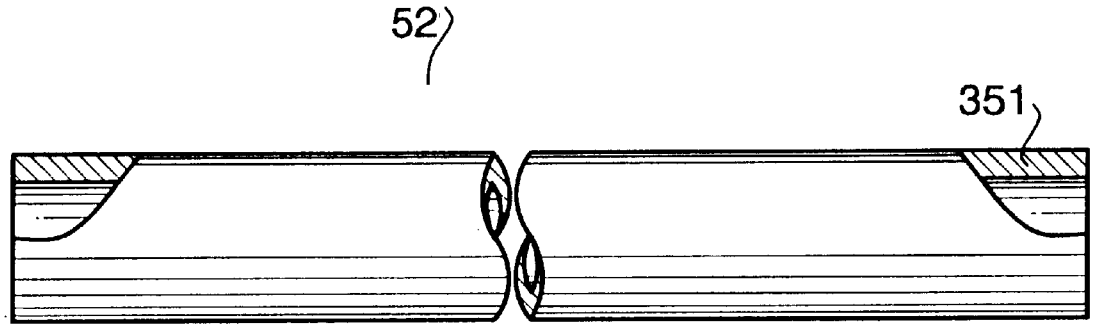
FIG. 16 illustrates a floor plan showing the supply reel of the facsimile apparatus according to Embodiment 2.

FIG. 16 illustrates a floor plan showing supply reel 52 of ink film unit 5 according to Embodiment 2. As shown in FIG. 16, supply reel 52 has a cylindrical form of a uniform diameter a little longer than the width of ink film unit 41 and is provided with through hollow section 351 of a uniform diameter a little greater than that of left end 154 of supply reel support 55 at the axial center.

By setting left ends 154 of supply reel supports 55 at both ends of hollow section 351 of supply reel 52, supply reel 52 is attached to two supply reel supports 55.

As in the case with Embodiment 1, attaching winding reel 43 to right side plate 56 and left side plate 57 completes the attachment of ink film unit 5.

Thus, the use of supply reel supports instead of a fixed shaft allows a reduction of both the number of parts and parts cost. Furthermore, inserting the coil springs into both sides of the supply reel to control the lateral movement of the supply reel stabilizes the winding operation of the ink film.

The appearance of ink film unit 5 when the attachment is completed is the same as that of ink film unit 4 of Embodiment 1 shown in FIG. 2 and the method of its attachment to the facsimile apparatus is also the same, and thus its explanation is omitted here.

(Embodiment 3)

Figure 17:
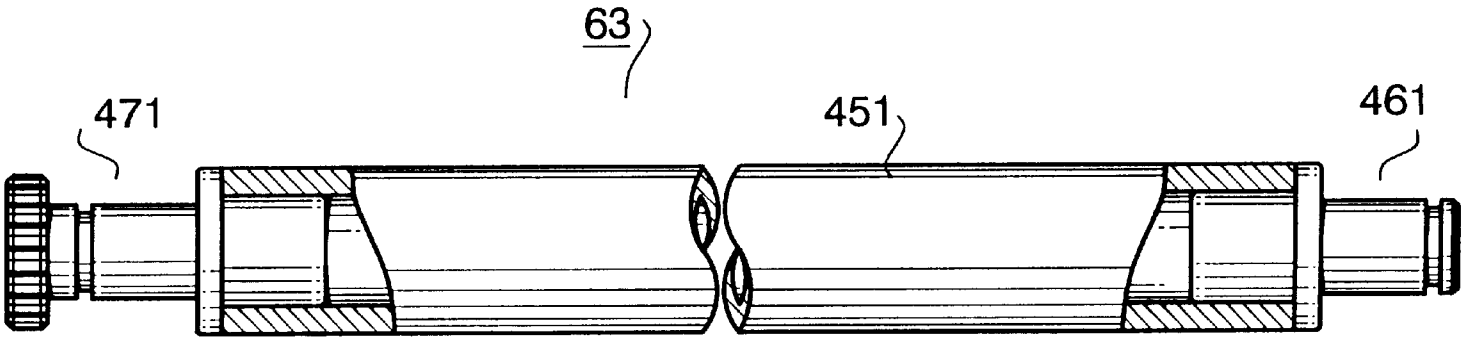
FIG. 17 illustrates a floor plan showing the winding reel of the facsimile apparatus according to Embodiment 3.

FIG. 17 is a floor plan of winding reel 63 of Embodiment 3. As shown in FIG. 17, Embodiment 3 provides winding reel 63 which can be broken down into winding reel body 451, winding reel right side 461 and winding reel left side 471.

Components except the winding reel of the ink film unit in Embodiment 3 are the same as those in Embodiment 2, and thus their explanations are omitted here.

Figure 18A:
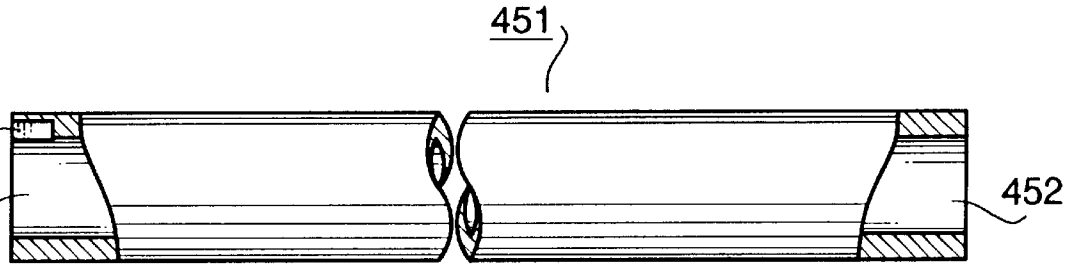
FIG. 18A and FIG. 18B illustrate floor plans showing the shape of the winding reel of the facsimile apparatus according to Embodiment 3.
Figure 18B:
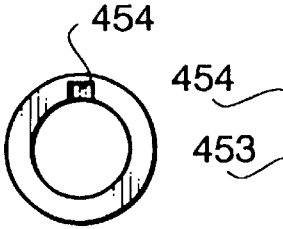

FIG. 18A and FIG. 18B are floor plans of winding reel body 451 in the ink film unit of Embodiment 3. FIG. 18A is its front sectional view and FIG. 18B is its left side view. As shown in FIG. 18A and FIG. 18B, winding reel body 451 has a cylindrical form of a uniform diameter a little longer than the width of ink film unit 41, and is provided with through hollow section 452 of a uniform diameter. On the inner wall of hollow section 452 is notch 454 of a prescribed depth from left side 453.

Figure 19:
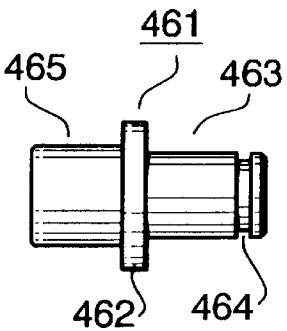
FIG. 19 illustrates a floor plan showing the shape of the right side of the winding reel of the facsimile apparatus according to Embodiment 3.

FIG. 19 is a floor plan of winding reel right side 461 of the ink film unit in Embodiment 3. As shown in FIG. 19, winding reel right side 461 has a concentric multi-cylindrical form. Central section 462 has a cylindrical form of a uniform diameter and right end 463 is shaved to a cylindrical form thinner than central section 462 and is provided with groove 464 which is shaved to a certain width and depth. Left side 464 of winding reel right side 461 is shaved to a cylindrical form thinner than hollow section 452 of winding reel body 451.

Figure 20B:
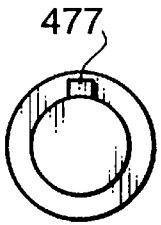
FIG. 20A and FIG. 20B illustrate floor plans showing the shape of the left side plate of the winding reel of the facsimile apparatus according to Embodiment 3.
Figure 20A:
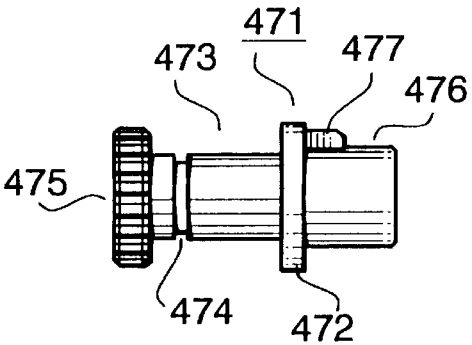

FIG. 20A and FIG. 20B are floor plans of winding reel left side 471 of the ink film unit in Embodiment 3. FIG. 20A is its front view and FIG. 20B is its right side view. As shown in FIG. 20A and FIG. 20B, winding reel left side 471 has a concentric multi-cylindrical form and central section 472 has a cylindrical form of a uniform diameter. Left side 473 has cogwheel 474 which is concentric and integrated therewith and is provided with groove 475 which is shaved to a certain width and depth. Left end 476 of winding reel left side 471 is shaved to a cylindrical form thinner than hollow section 452 of winding reel body 451 and is provided with protrusion 477 which can be inserted into notch 454 of winding reel body 451.

Attaching left end 464 of winding reel right side 461 to the right end of hollow section 452 of winding reel body 451 and then right end 476 of winding reel left side 471 to the left end of hollow section 452 in such a way that protrusion 477 of winding reel left side 471 is inserted into notch 454 completes the assembly of winding reel 63. This makes it possible to reduce the weight of winding reel 63.

Figure 21:
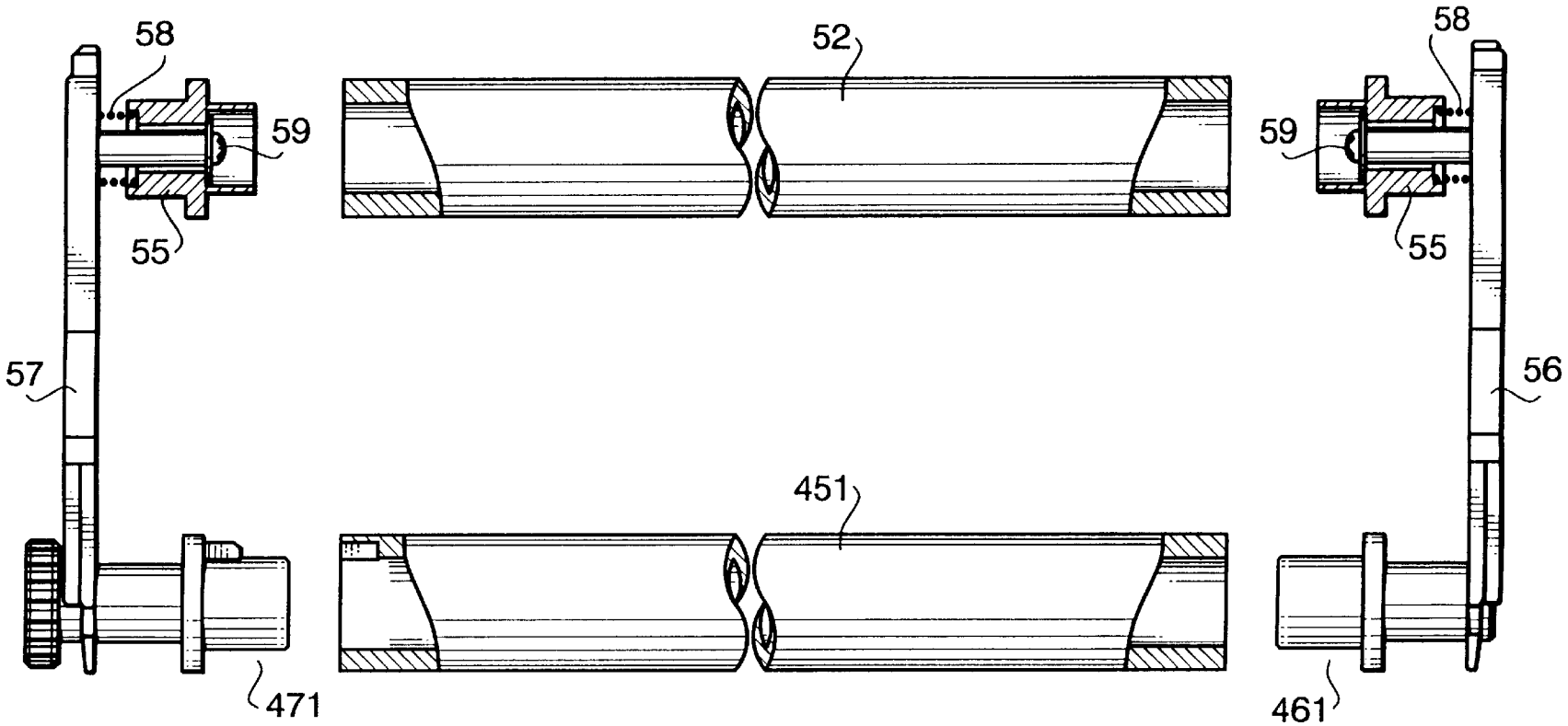
FIG. 21 illustrates an outlined top view of the ink film unit of the facsimile apparatus according to Embodiment 3.

Furthermore, using winding reel 63 with the above configuration for ink film unit 5 allows ink film unit 5 to be easily broken down into supply reel 52 to which ink film 41 is attached, winding reel body 451 and other parts as shown in FIG. 21, making it easier to replace the ink film.

What is claimed is:

1. A facsimile apparatus, comprising:

an ink film unit capable of being detachably mounted in said facsimile apparatus, comprising:

an ink film;

a feeding reel around which said ink film is wound;

a winding reel capable of winding up said ink film; and a pair of tabular ink film holders that rotatably support opposing ends of said feeding reel and said winding reel and that regulate a position of each of said feeding reel and said winding reel relative to said pair of tabular ink film holders; and a groove, formed inside said facsimile apparatus, said groove engaging said pair of tabular ink holders and regulating a position of said pair of tabular ink holders relative to said facsimile machine along a direction parallel to an axis of said feeding reel, said groove guiding said ink film unit to a predetermined position within said facsimile apparatus.

2. The apparatus according to claim 1, further comprising a holder formed inside said facsimile apparatus, capable of engaging said pair of tabular ink holders to guide said ink film unit to a predetermined position and preventing movement of said ink holders along both a direction perpendicular to an axis of said feeding reel and a direction perpendicular to said winding reel.

3. The apparatus according to claim 1, further comprising:

said feeding reel including a penetrating fixed shaft mounted inside a hollow cylindrical shaft;

one of said pair of tabular ink film holders having a hole with a diameter less than a diameter of said fixed shaft, said hole having a notch and a groove formed adjacent said notch;

wherein one end of said fixed shaft is inserted through the notch and engages said groove, and the other end of said fixed shaft is fixed directly to the other of said pair of tabular ink film holders.

4. The apparatus according to claim 1, further comprising a pair of springs, each mounted on said opposing ends of said feeding reel to prevent said feeding reel from moving axially.

5. The apparatus according to claim 1, wherein said tabular ink film holders include circular supports that rotatably support said winding reel and openings that guide said winding reel to said circular supports, and said winding reel has grooves at said opposing ends that engage with said circular supports of the ink film holders.

6. The apparatus according to claim 1, wherein said winding reel includes a winding reel body that winds the ink film, and left and right sides that are detachable from said winding reel body.

7. The apparatus according to claim 1, wherein each of said pair of tabular ink film holders comprises a tab, each said tab protruding upwardly from the corresponding tabular ink film holder, and each of said pair of ink film holders is stored in said groove from a direction vertical to said guide member, each said tab being placed toward the front of the tabular ink film holder in a mounting direction, and each said tab being shaped such that said tab can move the tabular ink film holders back and forth in the mounting direction.

8. The apparatus according to claim 7, wherein the tab has, at a side portion thereof, a plurality of convex portions shaped for preventing the tab from slipping from a user's grasp.

9. A facsimile apparatus, comprising:

a first roller capable of feeding recording paper to said facsimile apparatus;

a recording head which records image data on said recording paper fed by said roller, an ink film unit detachably mounted in said facsimile apparatus, comprising:

an ink film for use by said recording head;

a feeding reel around which said ink film is wound;

a winding reel capable of winding up said ink film; and a pair of tabular ink film holders that rotatably support opposing ends of said feeding reel and said winding reel and that regulate a position of each of said feeding reel and said winding reel relative to said pair of tabular ink film holders;

a second roller capable of discharging said recording paper on which image data is recorded by said recording head;

a scanner, detachably attached to said facsimile apparatus, capable of scanning a document;

a groove, formed inside said facsimile apparatus, which guides said ink film unit and prevents said pair of tabular ink film holders from moving in a direction parallel to an axis of said feeding reel;

a holder, formed inside said facsimile apparatus, said holder engaging said pair of tabular ink holders and regulating a position of said pair of tabular ink film holders relative to said facsimile machine along both a direction perpendicular to an axis of said feeding reel and a direction perpendicular to said winding reel, said holder guiding said ink film unit to a predetermined position within said facsimile apparatus.

10. An ink film unit, comprising:

a feeding reel around which an ink film is wound;

a winding reel that winds up said ink film;

a pair of tabular ink film holders that rotatably hold opposing ends of said feeding reel and said winding reel; and a first spring positioned between one of said opposing ends of said feeding reel and one of said pair of tabular ink film holders, and a second spring positioned between the other of said opposing ends of said feeding reel and the other of said pair of tabular ink film holders, wherein said first and second springs resist axial movement of said feeding reel in opposing axial directions and stabilize the winding operation of the ink film.

11. An ink film unit according to claim 10, wherein said pair of tabular ink film holders comprises a right side plate and a left side plate, and each said right side plate and said left side plate further comprises an upwardly extending tab for gripping said plates, whereby said tabs may be utilized to position said ink film unit within an ink film holder device.

12. An ink film unit according to claim 11, wherein each said right side plate and said left side plate includes a plurality of reinforcement beams.

13. An ink film unit according to claim 11, wherein each of said tabs further comprises front and rear irregular surfaces that facilitate gripping.

14. An ink film unit according to claim 10, wherein said pair of tabular ink film holders comprise a right side plate and a left side plate, and each said right side plate and said left side plate further comprises a downwardly extending portion configured to be engageable with an ink film holder device.

15. An ink film unit according to claim 10, wherein said pair of tabular ink film holders comprises a right side plate and a left side plate, and each said right side plate and said left side plate further comprises a downwardly extending portion having a shape complementary to an ink film holder device for interfitting therewith.

16. An ink film unit for a facsimile apparatus having ink film holder grooves, said ink film unit comprising:

a feeding reel around which an ink film is wound;

a winding reel that winds up said ink film;

a pair of tabular ink film holders that rotatably hold opposing ends of said feeding reel and said winding reel; and said feeding reel, said winding reel, and said pair of tabular ink film holders comprising a one-piece unit that is insertable and removable as a unit from the facsimile apparatus and wherein said pair of tabular ink film holders are engageable with the ink film holder grooves of the facsimile apparatus so that said feeding reel and said winding reel are supported and positively positioned relative to the facsimile apparatus by said pair of tabular ink film holders.

17. An ink film unit according to claim 16, wherein said pair of tabular ink film holders comprises a right side plate and a left side plate, and each said right side plate and said left side plate further comprises an upwardly extending tab for gripping said plates, whereby said tabs may be utilized to position said ink film unit within the ink film holder grooves.

18. An ink film unit according to claim 17, wherein each said right side plate and said left side plate includes a plurality of reinforcement beams.

19. An ink film unit according to claim 17, wherein each of said tabs further comprises front and rear irregular surfaces that facilitate gripping.

20. An ink film unit according to claim 16, wherein said pair of tabular ink film holders comprise a right side plate and a left side plate, and each said right side plate and said left side plate further comprises a downwardly extending portion configured to be engageable with the ink film holder grooves on the facsimile apparatus.

21. An ink film unit according to claim 16, wherein said pair of tabular ink film holders comprises a right side plate and a left side plate, and each said right side plate and said left side plate further comprises a downwardly extending portion having a shape complementary to the ink film holder grooves on the facsimile apparatus for interfitting therewith.

22. An ink film unit, comprising:

a first tabular ink film holder including a screw hole and a first deformable slot;

a second tabular ink film holder including a notched hole and a second deformable slot;

a feeding reel around which an ink film is wound, said feeding reel being rotatable about a shaft including a tapped hole at one end thereof and protrusions on an opposite end thereof, said feeding reel being secured between said first tabular ink film holder and said second tabular ink film holder by engaging said protrusions and said shaft to said notched hole and securing a screw through said first tabular ink film holder to said tapped hole of said shaft; and a winding reel that winds up said ink film, said winding reel being secured between said first tabular ink film holder and said second tabular ink film holder by forcing and fitting reel ends of said winding reel into said first and second deformable slots.

* * * * *